US010983469B2

(12) United States Patent
Ishii et al.

(10) Patent No.: US 10,983,469 B2
(45) Date of Patent: Apr. 20, 2021

(54) IMAGE READING DEVICE, IMAGE INSPECTION DEVICE, AND IMAGE FORMING APPARATUS

(71) Applicants: Tatsuya Ishii, Kanagawa (JP); Yoshio Konno, Kanagawa (JP)

(72) Inventors: Tatsuya Ishii, Kanagawa (JP); Yoshio Konno, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/005,279

(22) Filed: Aug. 27, 2020

(65) Prior Publication Data

US 2021/0080888 A1 Mar. 18, 2021

(30) Foreign Application Priority Data

Sep. 18, 2019 (JP) ..... JP2019-169267

(51) Int. Cl.
*G03G 15/00* (2006.01)
*G03G 21/18* (2006.01)

(52) U.S. Cl.
CPC ..... *G03G 15/5041* (2013.01); *G03G 15/5025* (2013.01); *G03G 15/556* (2013.01); *G03G 21/1857* (2013.01)

(58) Field of Classification Search
CPC ..... G03G 15/5025; G03G 15/5041; G03G 15/556; G03G 21/1857
See application file for complete search history.

(56) References Cited

U.S. PATENT DOCUMENTS

| | | | | |
|---|---|---|---|---|
| 10,877,420 | B2 * | 12/2020 | Kobayashi | G03G 15/231 |
| 2018/0278807 | A1 | 9/2018 | Miwa | |
| 2019/0166274 | A1 | 5/2019 | Ishii et al. | |
| 2019/0166275 | A1 | 5/2019 | Ishii et al. | |
| 2019/0300310 | A1 | 10/2019 | Ishii et al. | |
| 2020/0099812 | A1 | 3/2020 | Ishii | |

FOREIGN PATENT DOCUMENTS

| | | | | |
|---|---|---|---|---|
| JP | 2016-180857 | | 10/2016 | |
| JP | 2018-157413 | | 10/2018 | |
| JP | 2018-157529 | | 10/2018 | |
| JP | 2020-57902 | * | 4/2020 | G03G 15/01 |

* cited by examiner

*Primary Examiner* — Hoang X Ngo
(74) *Attorney, Agent, or Firm* — Duft & Bornsen, PC

(57) ABSTRACT

An image reading device includes a reader, a first background part, a second background part, and circuitry. The reader reads a pattern formed on a medium. The first and second background parts are disposed opposite the reader via a conveyance passage of the medium. The second background part has a higher light reflectance than that of the first background part. The circuitry moves one of the first and second background parts to a facing position at which the one faces the reader via the conveyance passage of the medium. The circuitry moves the first background part to the facing position in a case in which the pattern is a light color and the medium is transparent. The circuitry moves the second background part to the facing position in a case in which the pattern is a dark color darker than the light color or the medium is not transparent.

7 Claims, 5 Drawing Sheets

FIG. 3

| TONER COLOR | TRANSPARENCY | SHEET THICKNESS | BACKGROUND PART | COLOR SPACE CONVERSION PARAMETER |
|---|---|---|---|---|
| W | TRANSPARENT | THICK | BLACK SMALL-DIAMETER ROLLER | BLACK SMALL-DIAMETER PARAMETER |
| | | THIN | BLACK LARGE-DIAMETER ROLLER | BLACK LARGE-DIAMETER PARAMETER |
| W | NON-TRANSPARENT | THICK | WHITE SMALL-DIAMETER ROLLER | WHITE SMALL-DIAMETER PARAMETER |
| | | THIN | WHITE LARGE-DIAMETER ROLLER | WHITE LARGE-DIAMETER PARAMETER |
| KCMY | TRANSPARENT / NON-TRANSPARENT | THICK | WHITE SMALL-DIAMETER ROLLER | WHITE SMALL-DIAMETER PARAMETER |
| | | THIN | WHITE LARGE-DIAMETER ROLLER | WHITE LARGE-DIAMETER PARAMETER |

IMAGE READING DEVICE, IMAGE INSPECTION DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-169267, filed on Sep. 18, 2019, in the Japan Patent Office, the entire disclosure of which is hereby incorporated by reference herein.

BACKGROUND

Technical Field

Embodiments of the present disclosure relate to an image reading device, an image inspection device, and an image forming apparatus.

Related Art

There is known an image forming apparatus that performs calibration to keep stable variations in gradation characteristics due to individual differences among devices. The calibration refers to a process of reading a density correction pattern formed on a medium and generating correction curve information for correcting a gradation of image data according to density information of the read density correction pattern.

SUMMARY

In one embodiment of the present disclosure, a novel image reading device includes a reader, a first background part, a second background part, and circuitry. The reader is configured to read a pattern formed on a medium. The first background part is disposed opposite the reader via a conveyance passage of the medium. The second background part is disposed opposite the reader via the conveyance passage of the medium and having a higher light reflectance than a light reflectance of the first background part. The circuitry is configured to move one of the first background part and the second background part to a facing position at which the one of the first background part and the second background part faces the reader via the conveyance passage of the medium. The circuitry is configured to move the first background part to the facing position in a case in which the pattern is a light color and the medium is transparent. The circuitry is configured to move the second background part to the facing position in a case in which the pattern is a dark color darker than the light color or the medium is not transparent.

Also described are novel image inspection device incorporating the image reading device and image forming apparatus incorporating the image inspection device.

BRIEF DESCRIPTION OF THE DRAWINGS

A more complete appreciation of the embodiments and many of the attendant advantages and features thereof can be readily obtained and understood from the following detailed description with reference to the accompanying drawings, wherein:

FIG. 3 is a table defining relationships between toner colors, transparency, sheet thickness, background parts, and color space conversion parameters;

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
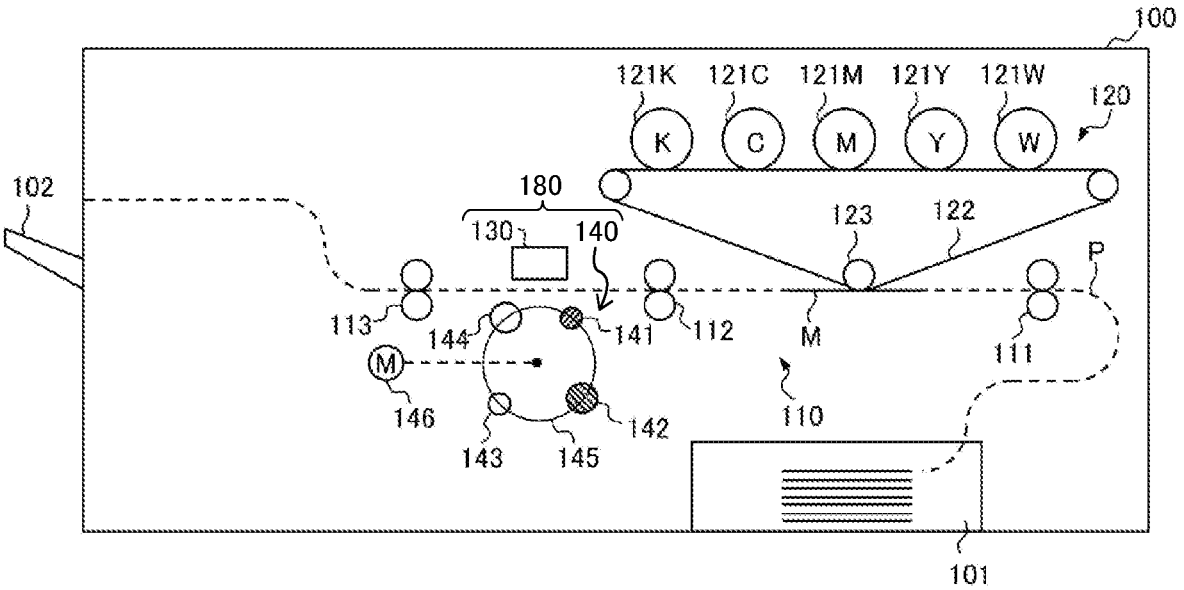
FIG. 1 is a schematic view of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

As used herein, the singular forms "a," "an," and "the" are intended to include the plural forms as well, unless the context clearly indicates otherwise.

It is to be noted that, in the following description, suffixes W, Y, M, C, and K denote colors of white, yellow, magenta, cyan, and black, respectively. To simplify the description, these suffixes are omitted unless necessary.

Referring to the drawings, wherein like reference numerals designate identical or corresponding parts throughout the several views, embodiments of the present disclosure are described below.

Figure 2:
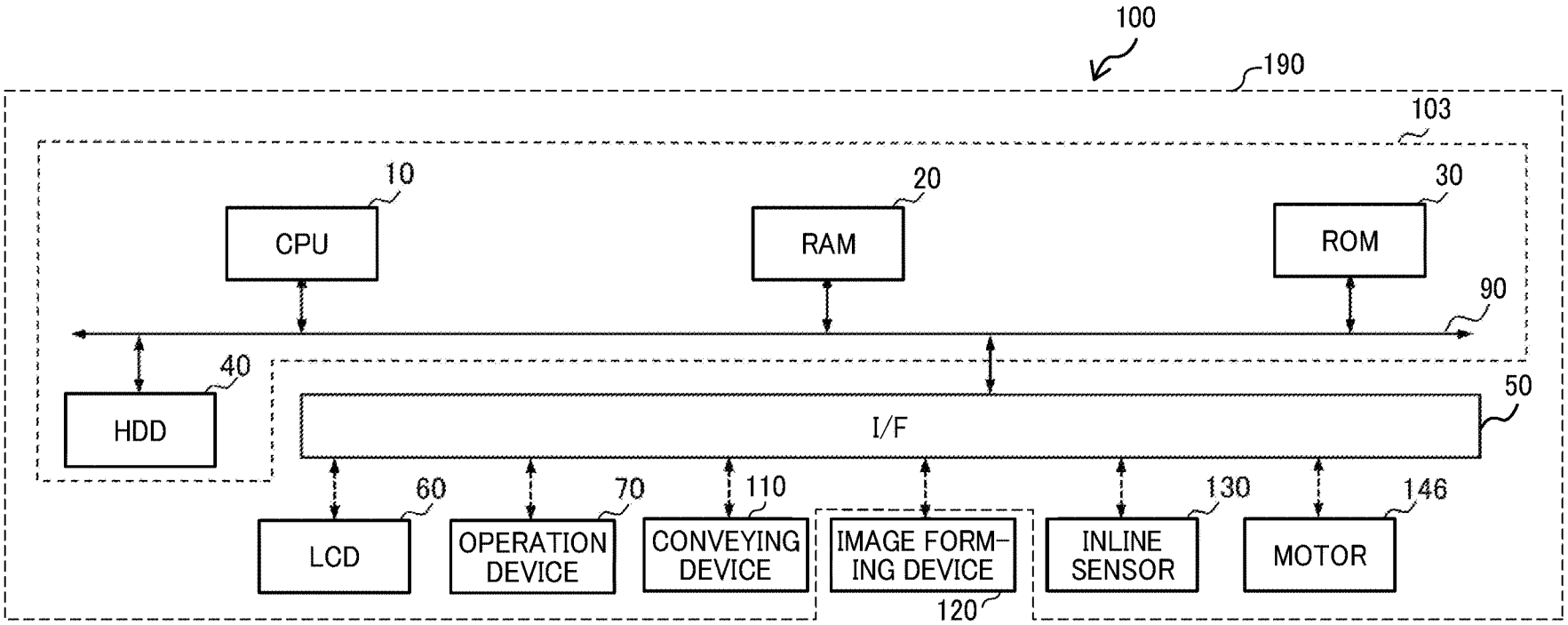
FIG. 2 is a block diagram illustrating a hardware configuration of the image forming apparatus.

Initially with reference to FIGS. 1 and 2, a description is given of an image forming apparatus 100 according to an embodiment of the present disclosure.

FIG. 1 is a schematic view of the image forming apparatus 100. FIG. 2 is a block diagram illustrating a hardware configuration of the image forming apparatus 100.

The image forming apparatus 100 includes an input tray 101, an output tray 102, a conveying device 110, an image forming device 120, an inline sensor 130 serving as a reader, and a background unit 140.

Sheets M bearing no images rest one atop another on the input tray 101. The sheet M herein serves as a medium. By contrast, the sheet M bearing an image rests on the output tray 102. Specific examples of the medium include plain paper, coated paper, thick paper, overhead projector (OHP) transparencies, plastic films, prepreg, and copper foil, provided that an image is recordable on the medium. In the embodiments of the present disclosure, a transparent or non-transparent medium is adoptable. In addition, media having various thicknesses are adoptable.

Inside the image forming apparatus 100, the sheet M is conveyed along or through a conveyance passage P, which is a space defined by internal components of the image forming apparatus 100. The conveyance passage P is a passage from the input tray 101 to the output tray 102 via a position opposite the image forming device 120 and a position opposite the inline sensor 130.

The conveying device 110 conveys the sheet M along the conveyance passage P. Specifically, the conveying device 110 conveys the sheet M from the input tray 101 to a position of or opposite the image forming device 120 along the conveyance passage P. Then, the conveying device 110 conveys the sheet M bearing an image formed by the image forming device 120 to a position of or opposite the inline sensor 130. After the inline sensor 130 reads the image of the sheet M, the conveying device 110 ejects the sheet M onto the output tray 102.

The conveying device 110 includes conveyance roller pairs 111, 112, and 113. Each of the conveyance roller pairs 111, 112, and 113 is constructed of, e.g., a driving roller and a driven roller. The driving roller is rotated by a driving force transmitted from a motor. The driven roller, in contact with the driving roller, is driven to rotate by rotation of the driving roller. The driving roller and the driven roller sandwiches the sheet M and rotate to convey the sheet M along the conveyance passage P.

The conveyance roller pair 111 is disposed upstream from the image forming device 120 in a sheet conveying direction in which the sheet M is conveyed. The conveyance roller pair 112 is disposed downstream from the image forming device 120 in the sheet conveying direction and upstream from the inline sensor 130 and the background unit 140 in the sheet conveying direction. The conveyance roller pair 113 is disposed downstream from the inline sensor 130 and the background unit 140 in the sheet conveying direction.

The image forming device 120 is disposed opposite the conveyance passage P between the conveyance roller pair 111 and the conveyance roller pair 112. The image forming device 120 forms an image on a front surface of the sheet M conveyed by the conveying device 110. The image forming device 120 of the present embodiment forms an image by electrophotography on the sheet M conveyed along the conveyance passage P. Instead of forming an image by electrophotography, however, the image forming device 120 may employ an inkjet printing system to form an image.

Specifically, the image forming device 120 has a tandem structure in which drum-shaped photoconductors 121W, 121Y, 121M, 121C, and 121K for different colors are arranged side by side along an endless conveyor belt 122 serving as a mover. Hereinafter, the photoconductors 121W, 121Y, 121M, 121C, and 121K may be collectively referred to as the photoconductors 121. More specifically, the photoconductors 121W, 121Y, 121M, 121C, and 121K are aligned in this order along the conveyor belt 122, from an upstream side of a moving direction of the conveyor belt 122, to form an intermediate transfer image on the conveyor belt 122. The intermediate transfer image is then transferred onto the sheet M fed from the input tray 101.

On a circumferential surface of each of the photoconductors 121 for different colors, a latent image is developed with toner as a colorant into a toner image. The toner images in different colors are transferred from the respective photoconductors 121 onto the conveyor belt 122 such that the toner images are superimposed one atop another on the conveyor belt 122. Thus, a composite full-color toner image (i.e., intermediate transfer image) is formed on the conveyor belt 122. A transfer roller 123 transfers the full-color image from the conveyor belt 122 onto the sheet M at a position closest to the conveyance passage P.

As described above, the latent images are developed with different colors of toner on the photoconductors 121W, 121Y, 121M, 121C, and 121K, respectively. Specifically, the latent images are developed with toner of white, yellow, magenta, cyan, and black on the photoconductors 121W, 121Y, 121M, 121C, and 121K, respectively. Accordingly, white, yellow, magenta, cyan, and black toner images are formed on the photoconductors 121W, 121Y, 121M, 121C, and 121K, respectively.

The inline sensor 130 optically reads the image (i.e., full-color toner image) formed on the sheet M by the image forming device 120 and outputs the reading to a controller 103. The inline sensor 130 mainly includes, e.g., a light emitting diode that emits light toward the conveyance passage P and photoelectric conversion elements that receive light reflected from the sheet M or from a black small-diameter roller 141, a black large-diameter roller 142, a white small-diameter roller 143, and a white large-diameter roller 144 described later. The photoelectric conversion elements convert the reflected light into electrical signals.

The inline sensor 130 is, e.g., a line sensor including the photoelectric conversion elements arrayed in a main scanning direction (i.e., width direction of the sheet M) perpendicular to the sheet conveying direction. An area in which the photoelectric conversion elements are arrayed is larger than a width (or width direction) of the sheet M. With such a configuration, the inline sensor 130 continuously reads the sheet M conveyed by the conveying device 110 to read the image formed on the sheet M. Note that the specific configuration of the inline sensor 130 is not limited to the aforementioned example.

The background unit 140 supports the sheet M at a position opposite the inline sensor 130 and serves as a background when the inline sensor 130 reads the sheet M. The background unit 140 is disposed opposite the inline sensor 130 via the conveyance passage P.

The background unit 140 includes the black small-diameter roller 141 serving as a first background part, the black large-diameter roller 142 serving as a first background part, the white small-diameter roller 143 serving as a second background part, and the white large-diameter roller 144 serving as a second background part, a holder 145, and a motor 146.

The black small-diameter roller 141 and the black large-diameter roller 142 are round-bar rotators having a black surface. Hereinafter, the black small-diameter roller 141 and the black large-diameter roller 142 may be collectively referred to as black rollers 141 and 142. The white small-diameter roller 143 and the white large-diameter roller 144 are round-bar rotators having a white surface. Hereinafter, the white small-diameter roller 143 and the white large-diameter roller 144 may be collectively referred to as white rollers 143 and 144.

The black small-diameter roller 141, the black large-diameter roller 142, the white small-diameter roller 143, and the white large-diameter roller 144 may be shaped like a cylinder or a tube. Hereinafter, the black small-diameter roller 141, the black large-diameter roller 142, the white small-diameter roller 143, and the white large-diameter roller 144 may be collectively referred to as rollers 141 to 144. The shape of the rollers 141 to 144 is not limited to the cylindrical or tubular shape. The rollers 141 to 144 may be arc-shaped plates.

Note that an outer shape of the rollers 141 to 144 is not limited to a circular, provided that the rollers 141 to 144 have a length sufficient to be a background of a pattern when the inline sensor 130 reads the pattern. A detailed description of the pattern is deferred. For example, the rollers 141 to 144 may have a curved or flat surface opposite the inline sensor 130.

The black large-diameter roller 142 has a diameter larger than a diameter of the black small-diameter roller 141. The white large-diameter roller 144 has a diameter larger than a diameter of the white small-diameter roller 143.

The color combination of the rollers 141 to 144 included in the background unit 140 is not limited to black and white, provided that the background unit 140 includes a first background part and a second background part having a higher light reflectance than a light reflectance of the first background part. In other words, the surface color of the first background part has a clear contrast with a light-colored pattern described later. In short, the first background part has a surface in dark color. By contrast, the surface color of the second background part has a clear contrast with a dark-colored pattern described later. In short, the second background part has a surface in light color. The number of rollers 141 to 144 is not limited to four. The number of each of the first background part and the second background part may be one, or not less than three.

The holder 145 is shaped like a ring to hold the rollers 141 to 144. Specifically, the ring-shaped holder 145 holds the rollers 141 to 144 at positions separated in a circumferential direction of the holder 145. The holder 145 is rotatably supported by a housing of the image forming apparatus 100.

The holder 145 is rotated by a driving force transmitted from the motor 146. As the holder 145 rotates, one of the black small-diameter roller 141, the black large-diameter roller 142, the white small-diameter roller 143, and the white large-diameter roller 144 is disposed at a facing position at which the one of the black small-diameter roller 141, the black large-diameter roller 142, the white small-diameter roller 143, and the white large-diameter roller 144 faces the inline sensor 130 via the conveyance passage P.

As illustrated in FIG. 2, the image forming apparatus 100 includes a central processing unit (CPU) 10, a random access memory (RAM) 20, a read only memory (ROM) 30, a hard disk drive (HDD) 40, and an interface (I/F) 50, which are connected to each other via a common bus 90.

The CPU 10 is a calculator or computing device that controls an overall operation of the image forming apparatus 100. The RAM 20 is a volatile storage medium that allows data to be read and written at high speed. The CPU 10 uses the RAM 20 as a work area for data processing. The ROM 30 is a read-only non-volatile storage medium that stores programs such as firmware. The HDD 40 is a non-volatile storage medium that allows data to be read and written and has a relatively large storage capacity. The HDD 40 stores, e.g., an operating system (OS), various control programs, and application programs.

The image forming apparatus 100 processes, by an arithmetic function of the CPU 10, e.g., a control program stored in the ROM 30 and an information processing program (or application program) loaded into the RAM 20 from a storage medium such as the HDD 40. Such processing configures a software controller including various functional modules of the image forming apparatus 100. The software controller thus configured cooperates with hardware resources of the image forming apparatus 100 construct functional blocks to implement functions of the image forming apparatus 100.

Specifically, the CPU 10, the RAM 20, the ROM 30, and the HDD 40 implement the controller 103 that controls the operation of the image forming apparatus 100. The RAM 20, the ROM 30, and the HDD 40 implement a storing unit.

The I/F 50 is an interface that connects a liquid crystal display (LCD) 60, an operation device 70, the conveying device 110, the image forming device 120, the inline sensor 130, and the motor 146 to the common bus 90. The LCD 60 displays various screens to notify, e.g., a user of information. The operation device 70 is an input interface that receives input of various types of information from the user. The operation device 70 includes, e.g., a push button and a touch panel superimposed on the LCD 60.

The HDD 40 stores a table illustrated in FIG. 3.

FIG. 3 is a table defining relationships between toner colors, transparency, sheet thickness, background parts, and color space conversion parameters.

Note that the table illustrated in FIG. 3 may be stored in the ROM 30 instead of the HDD 40.

A "toner color" column indicates a color of toner that forms a density correction pattern described later. "W" is an example of a light color. "KCMY" is an example of dark colors, namely, black, cyan, magenta, and yellow. The light color and the dark color are classified based on the magnitude of the luminance value (i.e., the amount of reflected light). Specifically, the light color has a very large luminance value. In addition to white, the light color refers to cream and light gray, for example. By contrast, the dark color has a smaller luminance value than the luminance value of the light color. In other words, the dark color is darker than the light color. In addition to black, the dark color refers to dark blue and dark brown, for example. However, the classification of the light color and the dark color is not limited to the aforementioned example. For example, yellow may be classified as a light color.

A "transparency" column indicates the transparency of the sheet M on which the density correction pattern is formed. In other words, the "transparency" column indicates whether or not the sheet M transmits light. The transparency refers to the transparency of the sheet M on which the density correction pattern is formed. In other words, the transparency refers to whether or not the sheet M transmits light. Specifically, "transparent" indicates that light is transmitted. In other words, "transparent" indicates that the light transmittance is not less than a threshold transmittance. By contrast, "non-transparent" indicates that light is not transmitted. In other words, "non-transparent" indicates that the light transmittance is less than the threshold transmittance.

A "sheet thickness" column indicates the thickness of the sheet M on which the density correction pattern is formed. "Thick" indicates that the thickness of the sheet M is not less than a threshold thickness. "Thin" indicates that the thickness of the sheet M is less than the threshold thickness.

A "background part" column indicates the rollers 141 to 144 corresponding to the combination of the toner color, the transparency, and the sheet thickness described above. The color space conversion parameter includes a parameter for converting first color information into second color information and a parameter for converting the second color information into density information. The color space conversion parameter is stored in the form of lookup table (LUT), for example.

According to the present embodiment, the color space conversion parameters are associated with the rollers 141 to 144 in a one-to-one correspondence. Specifically, a black small-diameter parameter is associated with the black small-diameter roller 141. A black large-diameter parameter is associated with the black large-diameter roller 142. A white small-diameter parameter is associated with the white small-diameter roller 143. A white large-diameter parameter is associated with the white large-diameter roller 144. Alternatively, a color space conversion parameter common to the black small-diameter roller 141 and the black large-diameter roller 142 and a color space conversion parameter common to the white small-diameter roller 143 and the white large-diameter roller 144 may be stored.

The controller 103 controls the conveying device 110 and the image forming device 120 to execute an image forming process of forming an image on the sheet M according to image data. The image data may be received from an external device such as a personal computer (PC) through a communication interface. Alternatively, the image data may be generated from a document scanned by a scanner installed in the image forming apparatus 100.

Specifically, the controller 103 rasterizes the image data. The controller 103 corrects a gradation of the rasterized image data according to correction curve information (described later) stored in the RAM 20 or the HDD 40. Then, the controller 103 causes the image forming device 120 to form an image according to the image data having the gradation corrected.

The controller 103 executes a calibration process prior to the image forming process. The calibration process is executed to generate correction curve information for correcting variations in gradation characteristics due to device characteristics.

Figure 4:
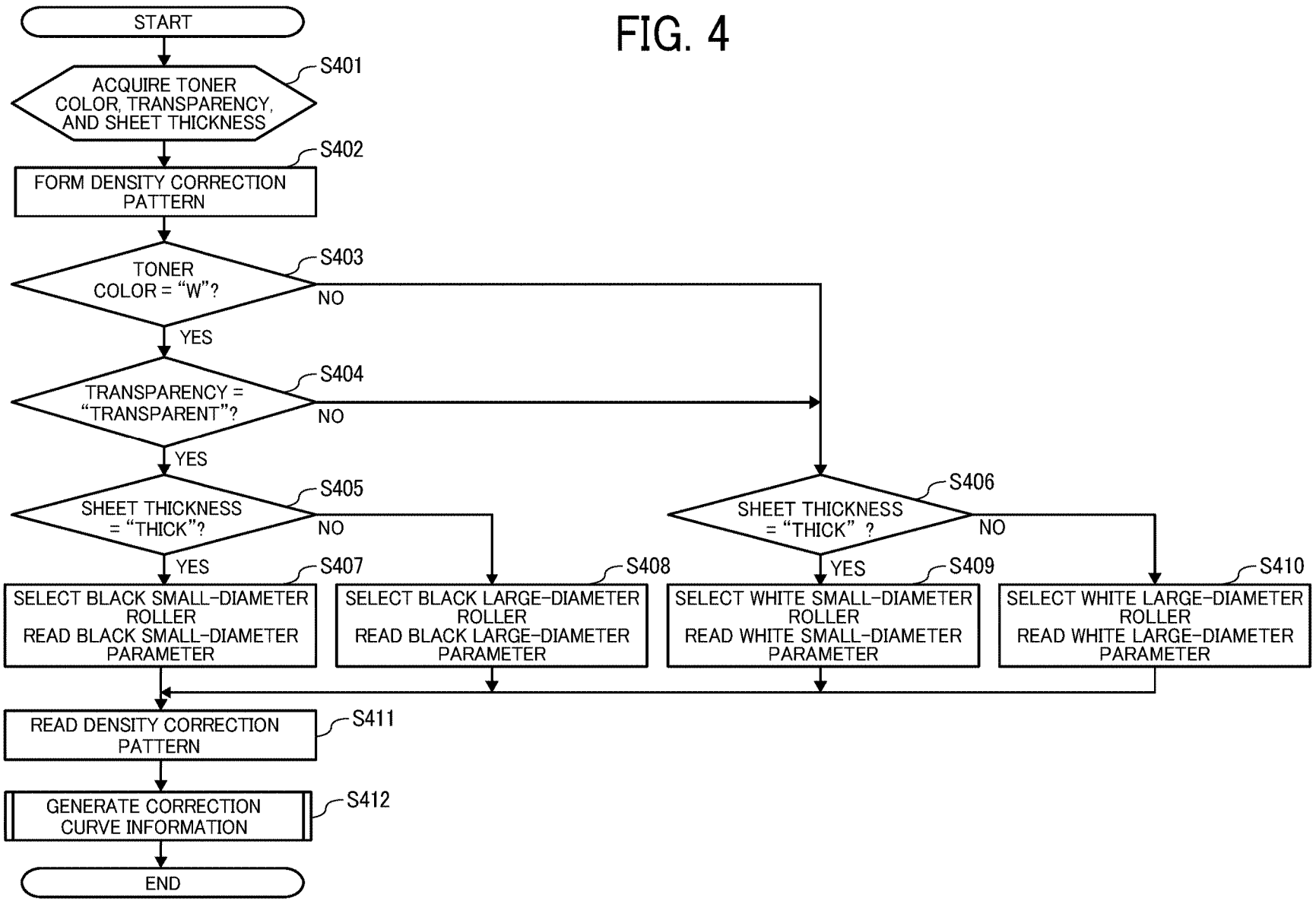
FIG. 4 is a flowchart of a calibration process.
Figure 5:
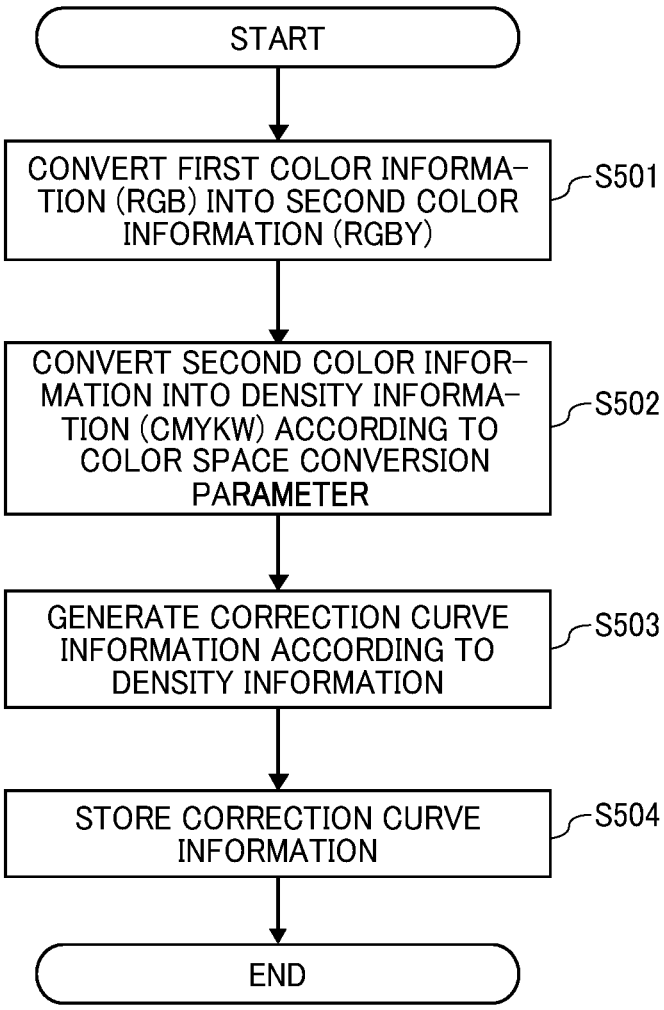
FIG. 5 is a flowchart of a correction curve information generating process.

Referring now to FIGS. 4 and 5, a detailed description is given of the calibration process and a correction curve information generating process.

FIG. 4 is a flowchart of the calibration process. FIG. 5 is a flowchart of the correction curve information generating process.

The calibration process illustrated in FIG. 4 starts according to an instruction from a user through the operation device 70, for example.

Firstly, in step S401, the controller 103 acquires the toner color, the transparency, and the sheet thickness. The controller 103 may receive a user operation for specifying the toner color, the transparency, and the sheet thickness through the operation device 70 in step S401, for example. Alternatively, the controller 103 may acquire such information through a sensor, for example, instead of allowing the user to specify the information.

Subsequently, in step S402, the controller 103 forms a density correction pattern on a sheet M. Specifically, the controller 103 causes the conveying device 110 to convey the sheet M from the input tray 101 to the position opposite the image forming device 120. Then, the controller 103 causes the image forming device 120 to form the density correction pattern with the toner color acquired in step S401.

In order to generate the correction curve information to correct a gradation of image data, the controller 103 causes the image forming device 120 to form the density correction pattern as an image. The density correction pattern is, e.g., an image in which patches (i.e., filled rectangular images) having different densities are aligned. Note that the pattern that the controller 103 causes the image forming device 120 to form is not limited to the density correction pattern. Alternatively, the controller 103 may cause the image forming device 120 to form, e.g., a sheet position detection pattern or a misalignment detection pattern.

Thereafter, in steps S403 to S406, the controller 103 specifies the toner color, the transparency, and the sheet thickness acquired in step S401. Subsequently, in one of steps S407 to S410, the controller 103 selects one of the rollers 141 to 144 according to the toner color, the transparency, and the sheet thickness specified in steps S403 to S406 and reads a color space conversion parameter corresponding to the selected one of the rollers 141 to 144 from the HDD 40.

Specifically, when the toner color is "W" (YES in step S403), the transparency is "transparent" (YES in step S404), and the sheet thickness is "thick" (YES in step S405), the controller 103 drives the motor 146 to move the black small-diameter roller 141 to the facing position and reads, from the HDD 40, the black small-diameter parameter associated with the black small-diameter roller 141 in step S407.

When the toner color is "W" (YES in step S403), the transparency is "transparent" (YES in step S404), and the sheet thickness is "thin" (NO in step S405), the controller 103 drives the motor 146 to move the black large-diameter roller 142 to the facing position and reads, from the HDD 40, the black large-diameter parameter associated with the black large-diameter roller 142 in step S408.

When the toner color is "W" (YES in step S403), the transparency is "non-transparent" (NO in step S404), and the sheet thickness is "thick" (YES in step S406), the controller 103 drives the motor 146 to move the white small-diameter roller 143 to the facing position and reads, from the HDD 40, the white small-diameter parameter associated with the white small-diameter roller 143 in step S409.

The same applies when the toner color is "KCMY" (NO in step S403) and when the sheet thickness is "thick" (YES in step S406).

When the toner color is "W" (YES in step S403), the transparency is "non-transparent" (NO in step S404), and the sheet thickness is "thin" (NO in step S406), the controller 103 drives the motor 146 to move the white large-diameter roller 144 to the facing position and reads, from the HDD 40, the white large-diameter parameter associated with the white large-diameter roller 144 in step S410.

The same applies when the toner color is "KCMY" (NO in step S403) and when the sheet thickness is "thin" (NO in step S406).

Subsequently, in step S411, the controller 103 causes the inline sensor 130 to read the density correction pattern formed on the sheet M by the image forming device 120. Specifically, the controller 103 causes the conveying device 110 to convey the sheet M such that the sheet M bearing the density correction pattern passes the position opposite the inline sensor 130.

The controller 103 causes the light emitting diode to emit light and the photoelectric conversion elements to receive the reflected light while the sheet M passes through the position opposite the inline sensor 130. Then, the controller 103 loads, as the first color information, electric signals output from the photoelectric conversion elements on the RAM 20.

The first color information indicates a pixel value of each pixel read by the inline sensor 130 as red, green, and blue (RGB) data, which is color information in an RGB color space. However, the specific example of the first color information is not limited to the aforementioned example.

Subsequently, in step S412, the controller 103 executes the correction curve information generating process. The correction curve information generating process is a process of generating correction curve information based on the first color information read in step S411, according to the color space conversion parameter read in one of steps S407 to S410.

Firstly, in step S501, the controller 103 converts the first color information read in step S411 into second color information according to the color space conversion parameter read in one of steps S407 to S410. In other words, the controller 103 generates the second color information in step S501. The second color information is, e.g., red, green blue, and yellow (RGBY) data, which is color information in an RGBY color space. Such conversion absorbs the device characteristic of the inline sensor 130 (i.e., individual differences among inline sensors), rendering unnecessary to be conscious of the device characteristic of the inline sensor 130 in the subsequent processing.

Subsequently, in step S502, the controller 103 converts the second color information generated in step S501 into density information according to the color space conversion parameter read in one of steps S407 to S410. In other words, the controller 103 generates the density information in step S502. The density information is, e.g., cyan, magenta, yellow, black, and white (CMYKW) data, which is color information in a CMYKW color space. Specifically, the density information is data indicating the density of 4096 tones.

Subsequently, in step S503, the controller 103 generates correction curve information according to the density information generated in step S502. Since typical processing is executable in steps S501 to S503, a detailed description of the processing of steps S501 to S503 is herein omitted.

Finally, in step S504, the controller 103 stores, in the HDD 40, the correction curve information generated in step S503.

Note that the details of the correction curve information generating process are not limited to the example illustrated in FIG. 5. For example, the processing of steps S501 and S502 is not limited to sequential execution. The controller 103 may convert the RGB data to CMYKW data at once. The controller 103 may collectively execute the calibration for each color of CMYKW. Alternatively, the controller 103 may execute the calibration of a light color (typically, white) alone. Specifically, in a case in which the controller 103 collectively executes the calibration for each color of CMYKW, the controller 103 causes the inline sensor 130 to read a density correction pattern formed in CMYKW and generate parameters for each color of CMYKW. On the other hand, in a case in which the controller 103 executes the calibration for white alone, the controller 103 causes the inline sensor 130 to read a density correction pattern formed in white on a transparent sheet and generate a parameter for white.

Typically, upon reading of a density correction pattern formed in a light color such as white on a transparent medium such as an OHP transparency, the density correction pattern may be confused with a light-colored background. Specifically, since the background color is transparent, the contrast between the density correction pattern and the background is insufficient for an inline sensor to read the density correction pattern. Such an insufficient contrast hampers generation of accurate correction curve information.

The embodiment described above prevents such an unfavorable situation.

A description is now given of some or all of advantages according to the embodiment described above, enumeration of which is not exhaustive or limiting.

According to the embodiment described above, the black rollers 141 and 142 are selected in a case in which a density correction pattern is formed in a light color on a transparent sheet M, whereas the white rollers 143 and 144 are selected in a case in which a density correction pattern is formed in a dark color on a transparent sheet M. Such selection clarifies the contrast between the density correction pattern and the background, thus preventing the inline sensor 130 from confusing the density correction pattern and the background color when reading the density correction pattern. As a consequence, in step S411, accurate first color information is generated.

In addition, according to the embodiment described above, the black small-diameter roller 141 or the white small-diameter roller 143 is selected in a case in which the sheet M is relatively thick, whereas the black large-diameter roller 142 or the white large-diameter roller 144 is selected in a case in which the sheet M is relatively thin. Such selection equalizes the distance between the sheet M and the inline sensor 130, thus reducing a reading error due to the thickness of the sheet M.

Further, according to the embodiment described above, since the correction curve information is generated based on the first color information read or generated by the way described above, the correction curve information suitable for the device characteristic is acquired. Accordingly, variations in gradation characteristics due to individual differences among devices are kept stable in the image forming process.

Note that, in the embodiment described above, a description has been given of an example in which a user or an operator inputs the transparency of the sheet M. As an example, the operator may select whether the sheet M is "transparent" or "non-transparent". As another example, the operator may input a numerical value indicating the transparency of the sheet M. For example, the operator may input a numerical value from 0 to 10 of 10 levels in which a greater numerical value (i.e., level) indicates a higher transparency. In this case, the controller 103 may determine that the sheet M is transparent when the numerical value input by the operator is not less than a threshold value, whereas the controller 103 may determine that the sheet M is non-transparent when the numerical value input by the operator is less than the threshold value.

As yet another example, the controller 103 may determine the transparency of the sheet M based on a type of the sheet M selected by the operator. Specifically, the controller 103 may determine that the sheet M is transparent when the operator selects, as the type of the sheet M, a transparent sheet, a clear file, or tracing paper, for example. The controller 103 may allow the operator to select the type of the sheet M, as an object to bear the density correction pattern, from a sheet type library stored in advance in the ROM 30 or the HDD 40.

In the embodiment described above, a description has been given of the image forming apparatus 100 that executes all of the image forming process, the calibration process illustrated in FIG. 4, and the correction curve information generating process illustrated in FIG. 5. Alternatively, the image forming process, the calibration process, and the correction curve information generating process may be separately executed by a plurality of devices.

As an example, the embodiments of the present disclosure are applicable to an image reading device 180 that includes the conveying device 110, the inline sensor 130, the background unit 140, and the controller 103. In this case, the image reading device 180 acquires the information indicating the toner color, the transparency, and the sheet thickness, together with the sheet M bearing the density correction pattern, from an image forming apparatus that has executed the processing of steps S401 and S402 illustrated in FIG. 4.

Then, the image reading device 180 executes the processing of steps S403 to S411 and outputs a result of reading (i.e., first color information) in step S411 illustrated in FIG. 4 to the image forming apparatus.

As another example, the embodiments of the present disclosure are applicable to an image inspection device 190 that includes the conveying device 110, the inline sensor 130, the background unit 140, and the controller 103. In this case, the image inspection device 190 acquires the information indicating the toner color, the transparency, and the sheet thickness, together with the sheet M bearing the density correction pattern, from an image forming apparatus that has executed the processing of steps S401 and S402 illustrated in FIG. 4. Then, the image inspection device 190 executes the processing of steps S403 to S412 and outputs correction curve information generated in step S503 illustrated in FIG. 5 to the image forming apparatus.

In the embodiment described above, a description has been given of an example in which rotation of the holder 145 switches between the rollers 141 to 144 to be disposed at the facing position. However, the specific configuration of the background unit 140 is not limited to the aforementioned example. As another example, a flat first background part and a flat second background part may be slid to the facing position.

According to the embodiments of the present disclosure, a pattern is read with an enhanced accuracy regardless of the type of medium on which the pattern is formed.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Any one of the above-described operations may be performed in various other ways, for example, in an order different from that described above.

Any of the above-described devices or units can be implemented as a hardware apparatus, such as a special-purpose circuit or device, or as a hardware/software combination, such as a processor executing a software program.

Further, each of the functions of the described embodiments may be implemented by one or more processing circuits or circuitry. Processing circuitry includes a programmed processor, as a processor includes circuitry. A processing circuit also includes devices such as an application-specific integrated circuit (ASIC), digital signal processor (DSP), field programmable gate array (FPGA) and conventional circuit components arranged to perform the recited functions.

Further, as described above, any one of the above-described and other methods of the present disclosure may be embodied in the form of a computer program stored on any kind of storage medium. Examples of storage media include, but are not limited to, floppy disks, hard disks, optical discs, magneto-optical discs, magnetic tapes, nonvolatile memory cards, read only memories (ROMs), etc.

Alternatively, any one of the above-described and other methods of the present disclosure may be implemented by the ASIC, prepared by interconnecting an appropriate network of conventional component circuits or by a combination thereof with one or more conventional general-purpose microprocessors and/or signal processors programmed accordingly.

What is claimed is:

1. An image reading device comprising:

a reader configured to read a pattern formed on a medium;

a first background part disposed opposite the reader via a conveyance passage of the medium;

a second background part disposed opposite the reader via the conveyance passage of the medium and having a higher light reflectance than a light reflectance of the first background part; and circuitry configured to move one of the first background part and the second background part to a facing position at which the one of the first background part and the second background part faces the reader via the conveyance passage of the medium, the circuitry configured to:

move the first background part to the facing position in a case in which the pattern is a light color and the medium is transparent; and move the second background part to the facing position in a case in which the pattern is a dark color darker than the light color or the medium is not transparent.

2. The image reading device according to claim 1, further comprising:

a ring-shaped holder configured to hold the first background part and the second background part at positions separated in a circumferential direction of the holder; and a motor configured to rotate the holder, wherein the circuitry is configured to drive the motor to move the one of the first background part and the second background part to the facing position.

3. The image reading device according to claim 2, further comprising:

another first background part different in diameter from the first background part; and another second background part different in diameter from the second background part, wherein the holder is configured to hold the first background part, said another first background part, the second background part, and said another second background part at positions separated in the circumferential direction of the holder, and wherein the circuitry is configured to:

move one of the first background part and said another first background part having a diameter corresponding to a thickness of the medium to the facing position in a case in which the pattern is the light color and the medium is transparent; and move one of the second background part and said another second background part having the diameter corresponding to the thickness of the medium to the facing position in a case in which the pattern is the dark color or the medium is not transparent.

4. The image reading device according to claim 1, wherein the first background part has a black surface, and wherein the second background part has a white surface.

5. An image inspection device comprising:

the image reading device according to claim 1; and a memory configured to store a color space conversion parameter, the circuitry configured to:

generate color information from the pattern read by the reader;

convert the color information into density information according to the color space conversion parameter stored in the memory; and generate, according to the density information, correction curve information to correct a gradation of image data.

6. The image inspection device according to claim 5, wherein the memory is configured to store another color space conversion parameter, wherein the color space conversion parameter and said another color space conversion parameter are associated with the first background part and the second background part, respectively, and wherein the circuitry is configured to convert the color information into the density information according to one of the color space conversion parameter and said another color space conversion parameter associated with the one of the first background part and the second background part disposed at the facing position.

7. An image forming apparatus comprising:

the image inspection device according to claim 5; and an image forming device configured to form, on the medium, an image having the gradation corrected with the correction curve information.

* * * * *